US009751340B2

(12) United States Patent
Hoshino

(10) Patent No.: US 9,751,340 B2
(45) Date of Patent: Sep. 5, 2017

(54) PRINTING MECHANISM AND THERMAL PRINTER

(71) Applicant: Seiko Instruments Inc., Chiba-shi, Chiba (JP)

(72) Inventor: Minoru Hoshino, Chiba (JP)

(73) Assignee: SEIKO INSTRUMENTS INC., Chiba (JP)

( * ) Notice: Subject to any disclaimer, the term of this patent is extended or adjusted under 35 U.S.C. 154(b) by 0 days.

(21) Appl. No.: 15/354,362

(22) Filed: Nov. 17, 2016

(65) Prior Publication Data

US 2017/0144457 A1 May 25, 2017

(30) Foreign Application Priority Data

Nov. 20, 2015 (JP) ..... 2015-227973

(51) Int. Cl.
*B41J 11/04* (2006.01)
*B41J 2/32* (2006.01)
(Continued)

(52) U.S. Cl.
CPC ..... *B41J 11/04* (2013.01); *B26D 1/025* (2013.01); *B26D 1/085* (2013.01); *B41J 2/32* (2013.01);
(Continued)

(58) Field of Classification Search
CPC ..... B41J 11/0045; B41J 11/006; B41J 11/70; A01B 12/006; B26D 2001/0066
See application file for complete search history.

(56) References Cited

U.S. PATENT DOCUMENTS 8,534,939 B2 * 9/2013 Yamaguchi ..... B41J 3/36 400/621
8,979,406 B2 * 3/2015 Kasugai ..... B41J 2/32 400/611
(Continued)

FOREIGN PATENT DOCUMENTS

EP 2 193 892 A1 6/2010
EP 2 338 689 A2 6/2011
(Continued)

OTHER PUBLICATIONS

Extended Search Report in corresponding European Application No. 16197812.7, dated Mar. 31, 2017, 8 pages.
(Continued)

*Primary Examiner* — Lamson Nguyen
(74) *Attorney, Agent, or Firm* — Brinks Gilson & Lione

(57) ABSTRACT

A printing mechanism has: a head mechanism including a printing head configured to print on a recording paper; a platen mechanism including a platen roller configured to nip the recording paper with the printing head to feed the recording paper; a fixed blade arranged in one mechanism of the head mechanism and the platen mechanism; and a movable blade arranged in another mechanism of the head mechanism and the platen mechanism in a slidable manner and configured to cut the recording paper with the fixed blade, the another mechanism comprising: a movable blade guide wall arranged upstream of the movable blade in a paper path direction of the recording paper; a first rib protruding from the movable blade guide wall to downstream of the paper path direction; and a second rib formed at a position on the movable blade guide wall, which is separated from the fixed blade with respect to the first rib in a movement direction of the movable blade.

10 Claims, 5 Drawing Sheets

(51) Int. Cl.

| | |
|---|---|
| ***B26D 1/02*** | (2006.01) |
| ***B26D 1/08*** | (2006.01) |
| ***B41J 11/00*** | (2006.01) |
| ***B41J 11/70*** | (2006.01) |
| *B26D 1/00* | (2006.01) |

(52) U.S. Cl.
CPC ..... *B41J 11/006* (2013.01); *B41J 11/0045* (2013.01); *B41J 11/70* (2013.01); *B26D 2001/0066* (2013.01)

(56) References Cited

U.S. PATENT DOCUMENTS

| | | | | |
|---|---|---|---|---|
| 9,682,584 | B2 * | 6/2017 | Yamaguchi | B41J 33/14 |
| 2009/0032637 | A1 | 2/2009 | Yoshioka | |
| 2015/0002605 | A1 | 1/2015 | Aizawa et al. | |
| 2015/0139686 | A1 | 5/2015 | Takenoshita et al. | |

FOREIGN PATENT DOCUMENTS

| | | | |
|---|---|---|---|
| EP | 2 556 963 | A1 | 2/2013 |
| EP | 2 913 193 | A1 | 9/2015 |
| JP | H03-217861 | A | 9/1991 |
| JP | 2002-137493 | A | 5/2002 |
| JP | 2013-111965 | A | 6/2013 |
| JP | 2015-030097 | A | 2/2015 |

OTHER PUBLICATIONS

Extended Search Report in corresponding European Application No. 16199307.6, dated Apr. 24, 2017, 8 pages.

* cited by examiner

PRINTING MECHANISM AND THERMAL PRINTER

RELATED APPLICATIONS

This application claims priority under 35 U.S.C. §119 to Japanese Patent Application No. 2015-227973 filed on Nov. 20, 2015,the entire content of which is hereby incorporated by reference.

BACKGROUND OF THE INVENTION

1. Field of the Invention

The present invention relates to a printing mechanism and a thermal printer.

2. Description of the Related Art

A thermal printer has been known as a printer configured to perform printing on a recording paper (heat-sensitive paper). A printing mechanism mounted to the thermal printer includes a head mechanism having a thermal head, and a platen mechanism having a platen roller configured to feed the recording paper. According to this configuration, the platen roller is rotated under a state in which the recording paper is nipped between the thermal head and the platen roller, to thereby convey the recording paper. When the recording paper passes through the thermal head, the thermal head is appropriately heated so that printing is performed on the recording paper.

Further, the printing mechanism includes a cutter mechanism configured to cut the recording paper having passed through the thermal head. The cutter mechanism includes, for example, a fixed blade incorporated in the head mechanism and a movable blade incorporated in the platen mechanism. According to this configuration, the movable blade is slid with respect to the fixed blade so that the recording paper is nipped and cut between the movable blade and the fixed blade. A position of the movable blade is detected, for example, by an optical sensor.

Incidentally, as the recording paper used in the above-mentioned thermal printer, a roll sheet wound around a core tube or the like is often used. Thus, the recording paper is conveyed under a state in which the recording paper has a curling with a predetermined curvature conforming to a winding direction of the roll sheet.

In this case, when the recording paper having been cut by the cutter mechanism remains in the vicinity of the delivery slot of the thermal printer without being taken, an upstream edge portion of the recording paper in a paper path direction may enter upstream of the cutter mechanism in the paper path direction due to the curling or the like. In this state, when the recording paper to be printed next is subjected to a cutting operation by the cutter mechanism, the upstream edge portion of the recording paper having been printed previously is cut together with the recording paper to be printed next. Then, the upstream edge portion of the recording paper having been printed previously is cut into a slender paper piece, and the slender paper piece may remain in the printing mechanism.

Here, between the movable blade and a frame for supporting the movable blade, a clearance is formed so that the movable blade can slide smoothly. In this case, when the above-mentioned paper piece or other foreign matters (hereinafter collectively referred to as "paper piece or the like") enter, for example, the clearance between the movable blade and the frame, the above-mentioned optical sensor may be covered with the paper piece or the like, or light projected from the optical sensor may be unintentionally blocked.

Consequently, erroneous operation of the movable blade or the like may be caused. Therefore, there is still room for improvement in view of improving reliability.

Under the above-mentioned circumstances, in this technical field, there have been demanded a printing mechanism and a thermal printer, which prevent entry of the paper piece or the like between the platen frame and the movable blade and are highly reliable.

SUMMARY OF THE INVENTION

According to one embodiment of the present invention, there is provided a printing mechanism, having: a housing having a roll sheet receiving portion; a head mechanism including a printing head configured to print on a recording paper; a platen mechanism including a platen roller configured to nip the recording paper with the printing head to feed the recording paper; a fixed blade arranged in one mechanism of the head mechanism and the platen mechanism; and a movable blade arranged in another mechanism of the head mechanism and the platen mechanism in a slidable manner and configured to cut the recording paper with the fixed blade, the another mechanism comprising: a movable blade guide wall arranged upstream of the movable blade in a paper path direction of the recording paper; a first rib protruding from the movable blade guide wall to downstream of the paper path direction; and a second rib formed at a position on the movable blade guide wall, which is separated from the fixed blade with respect to the first rib in a movement direction of the movable blade.

In the above-mentioned printing mechanism according to the one embodiment of the present invention, the movable blade is slidable between a cutting position at which the recording paper is cut between the movable blade and the fixed blade, and a separation position at which the movable blade is separated from the fixed blade; and the second rib is formed at a position on the movable blade guide wall, which corresponds to a blade edge of the movable blade at the separation position.

In the above-mentioned printing mechanism according to the one embodiment of the present invention, the another mechanism protrudes from the movable blade guide wall to downstream in the paper path direction, and includes a third rib for connecting the first rib and the second rib to each other.

In the above-mentioned printing mechanism according to the one embodiment of the present invention, a clearance between the second rib and the movable blade in the paper path direction is set to be 0.5 mm or less.

According to one embodiment of the present invention, there is provided a thermal printer, having: in the above-mentioned printing mechanism; and a casing to which the printing mechanism is mounted.

In the above-mentioned thermal printer according to the one embodiment of the present invention, the another mechanism is arranged below the one mechanism.

DETAILED DESCRIPTION OF THE PREFERRED EMBODIMENTS

Figure 1:
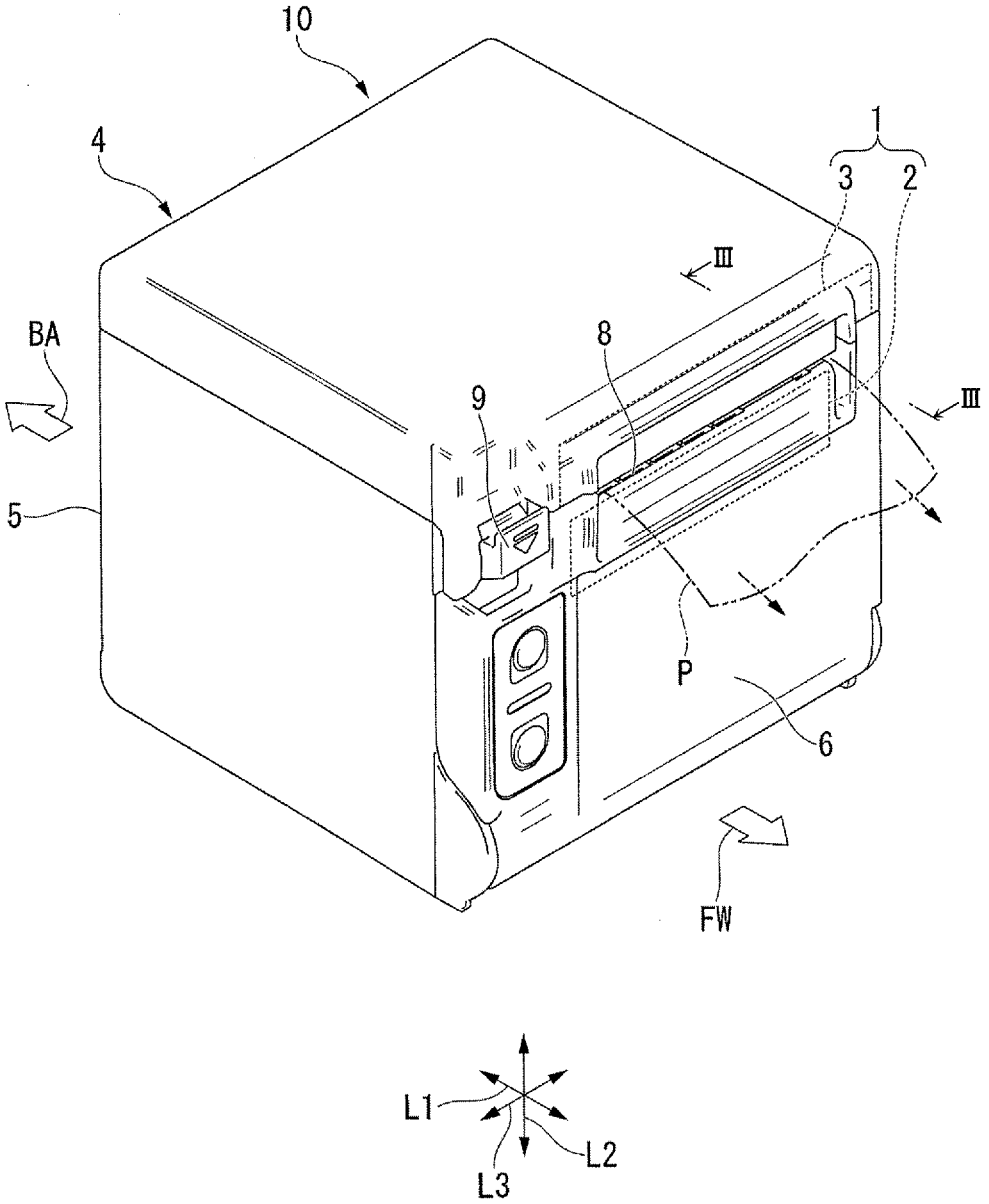
FIG. 1 is a perspective view for illustrating a thermal printer with a printer cover at a closing position.
Figure 2:
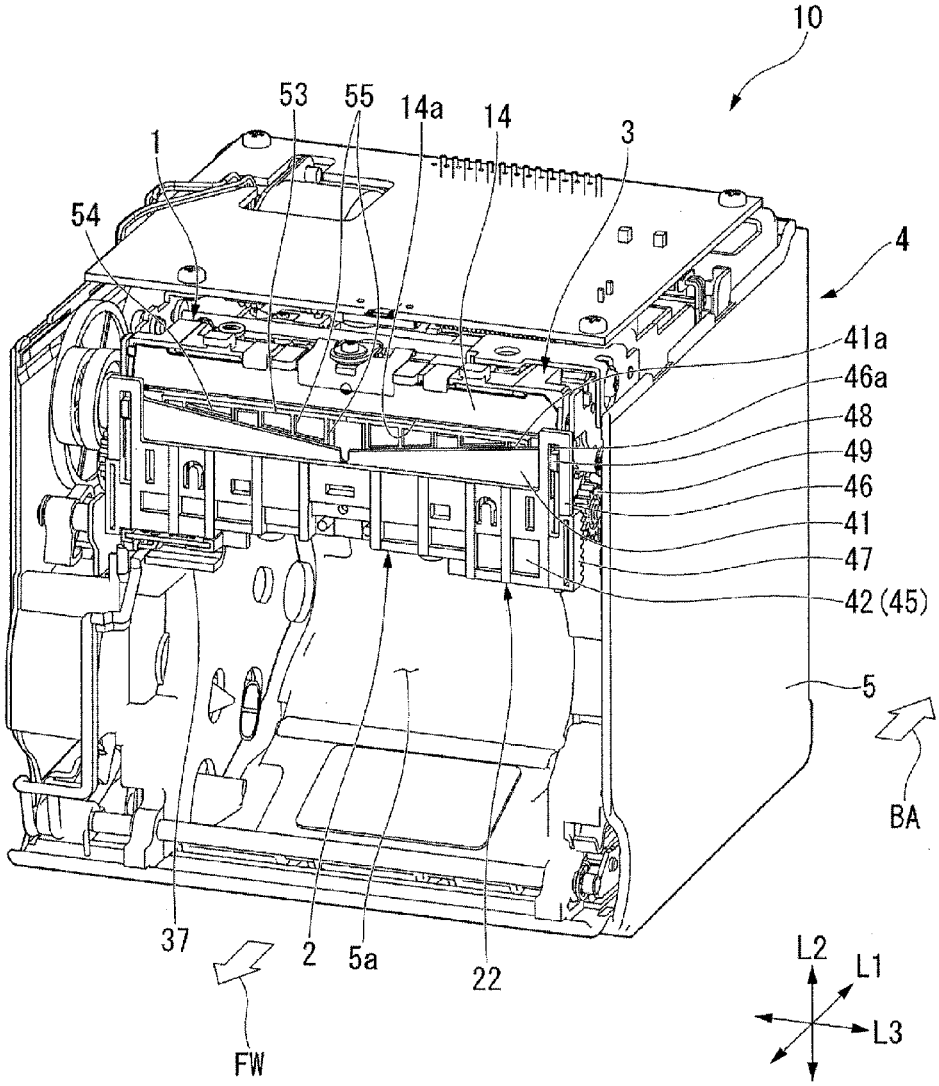
FIG. 2 is a perspective view for illustrating the inner structure of the thermal printer.

Next, an embodiment of the present invention is described with reference to the drawings. FIG. 1 is a perspective view for illustrating a thermal printer 10 with a printer cover 6 at a closing position. FIG. 2 is a perspective view for illustrating the inner structure of the thermal printer 10. As illustrated in FIG. 1 and FIG. 2, the thermal printer 10 of this embodiment is configured to perform printing on a recording paper P (heat-sensitive paper) drawn out from a roll sheet (not shown). The thermal printer 10 includes a printing mechanism 1 and a casing 4 for receiving the roll sheet.

The casing 4 is a so-called clamshell type (separate type). Specifically, the casing 4 includes a casing main body 5 and the printer cover 6. In this embodiment, with the printer cover 6 at the closing position as illustrated in FIG. 1, on the drawing sheet, a lower right side (printer cover 6 side) corresponds to the front (direction of the arrow FW), and an upper left side (casing main body 5 side) corresponds to the back (direction of the arrow BA). Further, an upper side corresponds to the top, and a lower side corresponds to the bottom. In this case, the recording paper P is delivered forward in the direction of the arrow FW (so-called forward delivery type). Further, directions orthogonal to forward and backward directions L1 and to upward and downward directions L2 are defined as rightward and leftward directions L3. Thus, the directions may be reversed depending on the drawings.

As illustrated in FIG. 2, the casing main body 5 is formed into a box shape. The casing main body 5 has a roll sheet receiving portion 5*a* for receiving the roll sheet. The roll sheet receiving portion 5*a* is opened forward.

As illustrated in FIG. 1, the printer cover 6 is coupled to the casing main body 5 in a pivotable manner with interposition of a hinge portion (not shown). With the printer cover 6 at the closing position, a delivery slot 8 which allows the recording paper P drawn out from the roll sheet to be delivered forward is formed between an opening edge of the casing main body 5 and a distal edge of the printer cover 6 (upper edge with the closing position). The reference symbol 9 in FIG. 1 denotes a releasing lever for opening the printer cover 6.

The printing mechanism 1 includes a platen mechanism (another mechanism) 2 arranged in the printer cover 6 and a head mechanism (one mechanism) 3 arranged in the casing main body 5.

Figure 3:
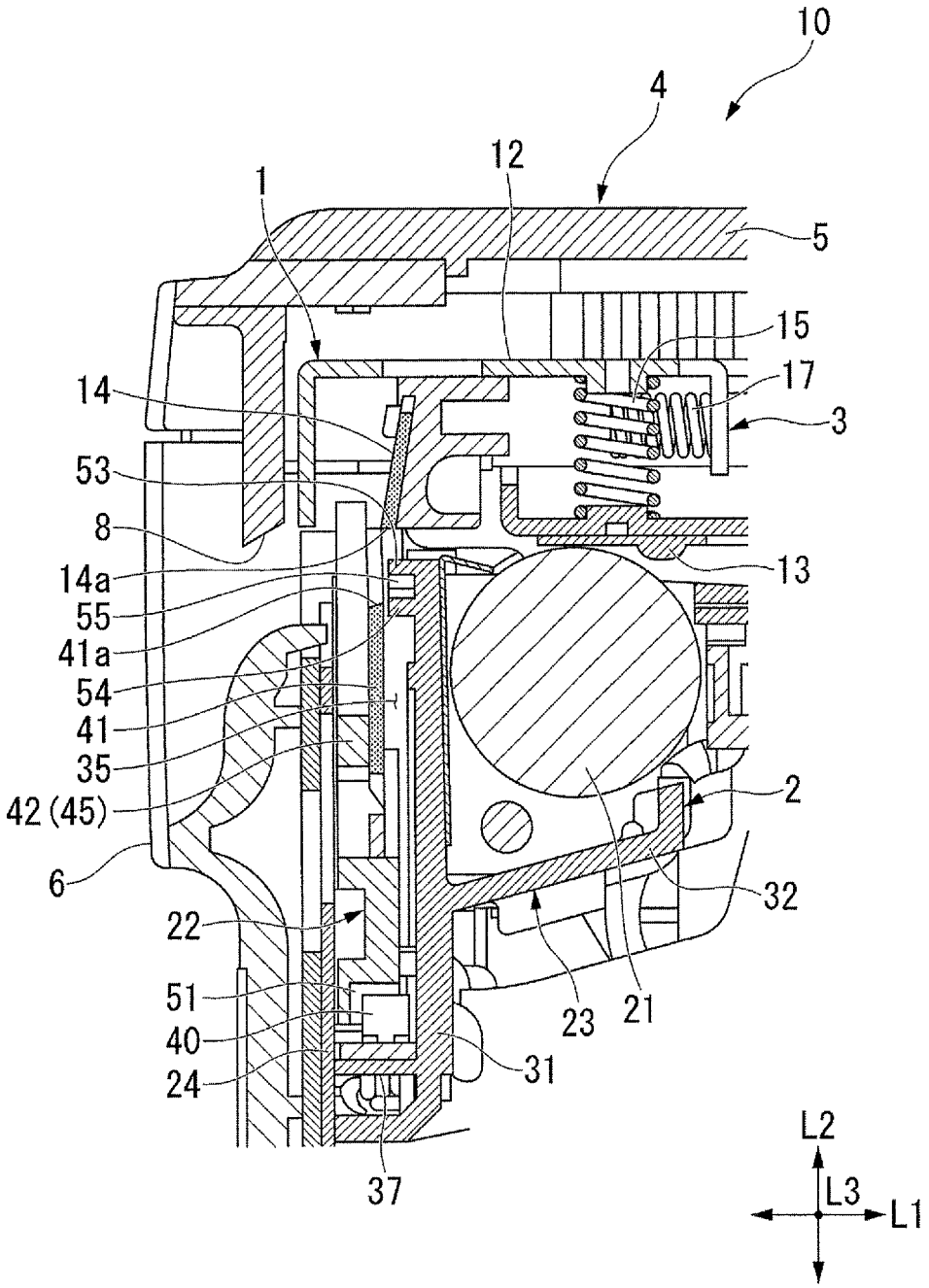
FIG. 3 is a sectional view taken along the line of FIG. 1.

FIG. 3 is a sectional view taken along the line III-III of FIG. 1. As illustrated in FIG. 1 and FIG. 3, the head mechanism 3 is mounted to a portion of the casing main body 5, which is located above the above-mentioned delivery slot 8. As illustrated in FIG. 3, the head mechanism 3 mainly includes a head frame 12, and a thermal head (printing head) 13 and a fixed blade 14 which are mounted to the head frame 12.

The head frame 12 is fixed to a portion located on a front side on an inner surface of an upper wall of the casing main body 5. The thermal head 13 is formed into a plate-like shape extending along the rightward and leftward directions L3. In the thermal head 13, a plurality of heating elements (not shown) are arrayed in the rightward and leftward directions L3. The thermal head 13 is supported by the head frame 12 so that the heat elements are oriented downward. The thermal head 13 is urged downward by a head urging member 15 interposed between the thermal head 13 and the head frame 12.

The fixed blade 14 is fixed to a portion of the head frame 12, which is located more on the front side than the thermal head 13. The fixed blade 14 is formed into a plate-like shape extending along the rightward and leftward directions L3. The fixed blade 14 is fixed to the head frame 12 under a state in which a blade edge 14*a* is oriented downward. In the example of FIG. 3, the blade edge 14*a* of the fixed blade 14 is arranged at a position overlapping with an upper end opening edge of the delivery slot 8 in front view as viewed from the front. The fixed blade 14 is urged forward by a movable blade urging member 17 interposed between the fixed blade 14 and the head frame 12.

The platen mechanism 2 is mounted to an inner surface of a distal end portion of the printer cover 6 (upper end portion with the closing position). Specifically, the platen mechanism 2 includes a platen roller 21, a movable blade 22, a platen frame 23 for supporting the platen roller 21 in a pivotable manner, and a movable blade frame 24 for supporting the movable blade 22. The movable blade frame 24 is fixed to an upper part of the inner surface of the printer cover 6. Specifically, the platen mechanism 2 is fixed to the printer cover 6 with interposition the movable blade frame 24. In FIG. 2, an illustration of the movable blade frame 24 is omitted.

Figure 4:
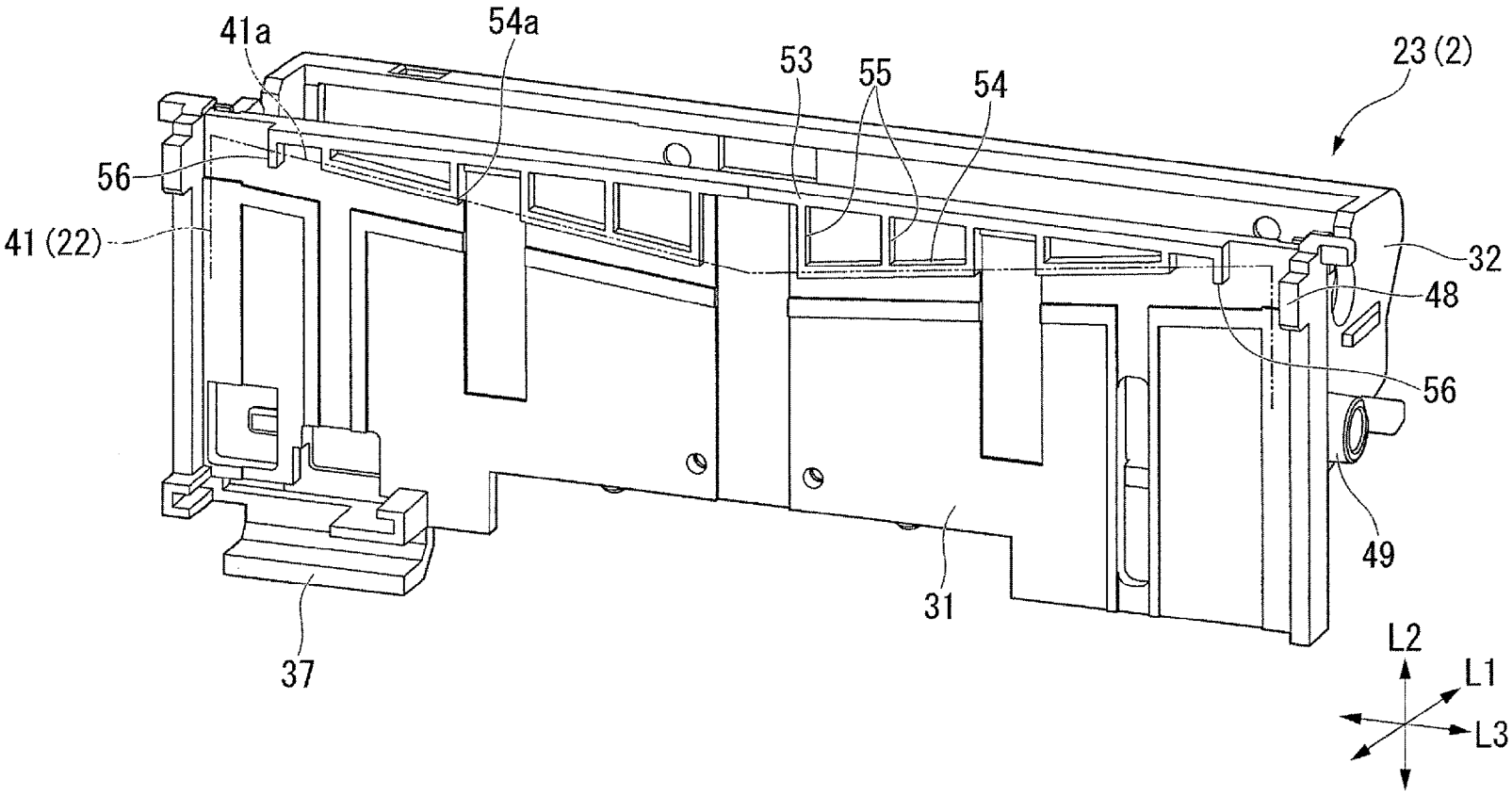
FIG. 4 is a perspective view of a platen frame as viewed from the front.

FIG. 4 is a perspective view of the platen frame 23 as viewed from the front. As illustrated in FIG. 3 and FIG. 4, the platen frame 23 is mounted behind the movable blade frame 24. Specifically, the platen frame 23 has a movable blade guide wall 31 and a platen receiving portion 32.

The movable blade guide wall 31 is arranged behind the movable blade frame 24 so as to be opposed to each other. In the forward and backward directions L1, a clearance between the movable blade guide wall 31 and the movable blade frame 24 forms a movable blade receiving portion 35 in which the movable blade 22 is received. The movable blade receiving portion 35 is opened at least upward. Further, a sensor support wall 37 is continuously arranged to a part of a lower end portion of the movable blade guide wall 31 in the rightward and leftward directions L3. The sensor support wall 37 is arranged so as to protrude forward from the movable blade guide wall 31. A sensor 40 (see FIG. 3) for detecting a position of the movable blade 22 is arranged on the sensor support wall 37. The sensor 40 is, for example, an optical sensor in which a light emitting portion and a light receiving portion are arranged to be opposed to each other.

The platen receiving portion 32 is continuously arranged backward from a halfway portion of the movable blade guide wall 31 in the upward and downward directions L2. The platen receiving portion 32 surrounds the platen roller 21 from both sides in the rightward and leftward directions L3, the bottom, and the back.

As illustrated in FIG. 3, the platen roller 21 is formed into a cylindrical shape extending in the rightward and leftward directions L3. The platen roller 21 is received in the platen receiving portion 32 under a state in which both ends of the platen roller 21 (platen shaft portion) in the rightward and leftward directions L3 are supported by the platen receiving portion 32 in a rotatable manner. In this case, the platen roller 21 is received in the platen receiving portion 32 under a state in which at least an upper part of the platen roller 21 protrudes upward from the platen receiving portion 32. The thermal head 13 comes into close contact with, from above, a part of an outer peripheral surface of the platen roller 21, which protrudes upward from the platen receiving portion 32, with the closing position of the printer cover 6. The platen roller 21 is rotated about a rotation axis extending in the rightward and leftward directions by an operation of a platen drive motor (not shown). Further, in the printing mechanism 1, on a paper path from a contact position between the platen roller 21 and the thermal head 13 to the delivery slot 8 of the casing 4, the recording paper P is conveyed along the forward and backward directions L1 (see FIG. 5). That is, on the above-mentioned paper path, downstream in a conveyance direction corresponds to the front, and upstream in the conveyance direction corresponds to the back.

The movable blade 22 is received in the movable blade receiving portion 35 so as to be slidable in the upward and downward directions L2 (moving direction of the movable blade 22). Specifically, as illustrated in FIG. 2 and FIG. 3, the movable blade 22 has a movable blade main body 41 and a holder 42 for holding the movable blade main body 41. The movable blade 22 constructs a cutter mechanism together with the above-mentioned fixed blade 14.

As illustrated in FIG. 2, the blade edge 41*a* of the movable blade main body 41 is formed into a V-shape in front view as viewed from the front. That is, the movable blade main body 41 is formed so that a length from a base to the blade edge 41*a* is gradually reduced as approaching from both ends in the rightward and leftward directions L3 to a central portion. In front view as viewed from the front, the movable blade main body 41 is arranged so that the central portion of the blade edge 41*a* in the rightward and leftward directions L3 is positioned below a lower opening edge of the delivery slot 8. In plan view as viewed from above, the movable blade main body 41 is slightly curved backward as approaching from both the ends in the rightward and leftward directions L3 to the central portion.

The holder 42 is formed into a plate-like shape extending along the rightward and leftward directions L3. The holder 42 includes a holding plate 45 for holding the movable blade main body 41 and guide rails 46 formed on both ends of the holding plate 45 in the rightward and leftward directions L3. As illustrated in FIG. 2 and FIG. 3, the holding plate 45 holds the movable blade main body 41 from the front and the bottom, under a state in which the blade edge 41*a* of the movable blade main body 41 protrudes upward. In this embodiment, a back surface of the movable blade main body 41 is exposed backward from the holding plate 45. Thus, the back surface of the movable blade main body 41 is opposed to the above-mentioned movable blade guide wall 31 in the forward and backward directions L1.

As illustrated in FIG. 2, the guide rail 46 protrudes upward with respect to the holding plate 45. In an upper part of the guide rail 46, a guide hole 46*a* passing through the guide rail 46 in the forward and backward directions L1 is formed. The guide hole 46*a* extends in the upward and downward directions L2. A guide protrusion 48 formed on the above-mentioned movable blade guide wall 31 is received in the guide hole 46*a* from the back. In a lower part of the guide rail 46, a rack 47 extending in the upward and downward directions L2 is formed. The rack 47 is held in mesh with a movable blade drive wheel train 49 for transmitting a driving force to the movable blade 22.

A driving force of a movable blade drive motor (not shown) arranged in the casing main body 5 is transmitted to the movable blade 22 through the movable blade drive wheel train 49 and the rack 47. With this, the movable blade 22 slides in the upward and downward directions L2. In this case, the movable blade 22 slides between a cutting position at which the recording paper P is cut between the movable blade 22 and the fixed blade 14, and a separation position at which the movable blade 22 is separated downward from the fixed blade 14. At the cutting position, the movable blade 22 is arranged so that the movable blade main body 41 rides over the fixed blade 14 from the front. Meanwhile, the separation position corresponds to a position (home position) at which the blade edge 41*a* of the movable blade main body 41 is separated downward the most from the blade edge 14*a* of the fixed blade 14.

As illustrated in FIG. 3, at a part of a lower end portion of the above-mentioned holding plate 45, which is opposed to the above-mentioned sensor support wall 37 in the upward and downward directions L2, a detection piece 51 protruding downward is formed. The detection piece 51 is detected by the sensor 40. With this, the sensor 40 detects that the movable blade 22 is at the separation position.

Herein, as illustrated in FIG. 4, on the above-mentioned movable blade guide wall 31, there are formed a plurality of ribs (upper rib 53, lower rib 54, and connecting ribs 55) protruding forward (downstream in the paper path direction). The upper rib (first rib) 53 is formed so as to protrude forward from an upper end of the movable blade guide wall 31. The upper rib 53 comes close to, from the back, an operation surface of the movable blade 22 during slide movement of the movable blade 22 (surface intersecting the forward and backward directions L1). Specifically, the upper rib 53 is continuously formed along the rightward and leftward directions L3 over regions other than both ends of the movable blade guide wall 31 in the rightward and leftward directions L3. Further, at both ends of the upper rib 53 in the rightward and leftward directions L3, outer ribs 56 extending downward are continuously formed. The upper rib 53 may be formed intermittently in the rightward and leftward directions L3. Further, the upper rib 53 may be formed over an entire region of the movable blade guide wall 31 in the rightward and leftward directions L3.

An upper end surface of the upper rib 53 is flush with an upper end surface of the movable blade guide wall 31. Meanwhile, a lower end surface of the upper rib 53 is arranged above the blade edge 41*a* of the movable blade main body 41 when the movable blade 22 is at the separation position. The upper rib 53 may be formed at an arbitrary position within a range between a position below or as high as the upper end surface of the movable blade guide wall 31 and a position above the lower rib 54.

The lower rib (second rib) 54 is formed so as to protrude forward from a portion on the movable blade guide wall 31, which is located below the upper rib 53. In front view as viewed from the front, the lower rib 54 is formed into a V-shape conforming to a shape of the blade edge 41*a* of the movable blade main body 41. That is, the lower rib 54 extends downward as approaching from both ends in the rightward and leftward directions L3 to a central portion.

The lower rib 54 is formed at a position on the movable blade guide wall 31, which corresponds to the blade edge 41*a* of the movable blade main body 41 when the movable blade 22 is at the separation position. In this embodiment, an upper end surface of the lower rib 54 is arranged above the blade edge 41*a* of the movable blade main body 41 when the movable blade 22 is at the separation position. Meanwhile, a lower end surface of the lower rib 54 is arranged below the blade edge 41*a* of the movable blade main body 41 when the movable blade 22 is at the separation position. However, the upper surface of the lower rib 54 may be arranged at a position corresponding to that of the blade edge 41*a* of the movable blade main body 41.

In the example of FIG. 4, a length of the lower rib 54 in the rightward and leftward directions L3 is shorter than that of the upper rib 53. However, the length of the lower rib 54 in the rightward and leftward directions L3 may be equal to or longer than that of the upper rib 53. Further, the lower rib 54 may continuously be formed in the rightward and leftward directions L3, or may be formed intermittently. In the example of FIG. 4, in a part of the lower rib 54 in the rightward and leftward directions L3, a clearance portion 54*a* obtained through cutting of the lower rib 54 is formed. The clearance portion 54*a* prevents interference between the lower rib 54 and the holder 42 along with the slide movement of the movable blade 22.

The connecting ribs (third ribs) 55 connect the upper rib 53 and the lower rib 54 to each other. Specifically, the connecting ribs 55 protrude forward from the movable blade guide wall 31, and a plurality of connecting ribs are formed in the rightward and leftward directions L3 at intervals. In this case, the lengths of the connecting ribs 55 in the upward and downward directions become shorter as approaching to both sides in the rightward and leftward directions L3. Front surfaces of the connecting ribs 55 are smoothly connected to front surfaces of the upper rib 53 and front surfaces of the lower rib 54. In this embodiment, in conformity with a curve of the movable blade main body 41, the front surfaces of the ribs 53 to 56 are slightly retreated backward as approaching from both the ends to the central portion in the rightward and leftward directions L3.

In this embodiment, protrusion heights of the ribs 53 to 56, which protrude forward, are set so as to prevent interference with the blade edge 41*a* of the movable blade main body 41 during the slide movement of the movable blade 22. In this case, as illustrated in FIG. 3, it is preferred that a distance between the front surfaces of the ribs 53 to 56 and the back surface of the movable blade main body 41 (operation surface of the movable blade 22) in the forward and backward directions L1 be set more than or equal to 0.05 mm and less than or equal to 0.5 mm through the entire ribs 53 to 56. Further, when variation of dimensions are taken into account, it is more preferred that the distance be set within a range of from about 0.15 mm to about 0.20 mm. The protrusion heights of the ribs 53 to 56 may be different from one another.

Figure 5:
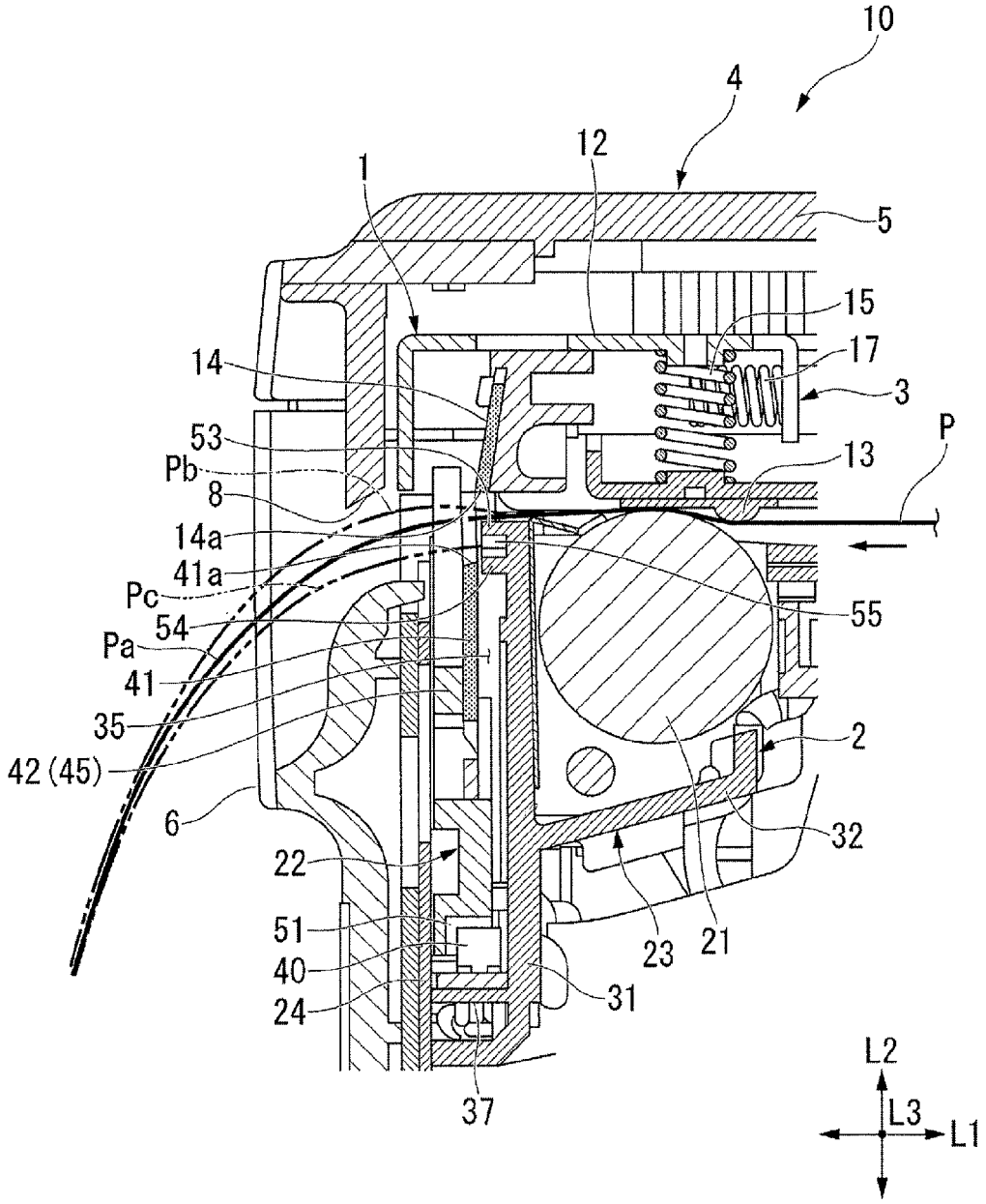
FIG. 5 is an explanatory view for illustrating an operation method of the thermal printer.

FIG. 5 is an explanatory view for illustrating an operation method of the thermal printer 10. In the thermal printer 10, as illustrated in FIG. 5, with the printer cover 6 at the closing position. Under a state in which both of the mechanisms 2 and 3 are coupled, the movable blade 22 and the fixed blade 14 are arranged at desired positions, and the recording paper P is nipped between the platen roller 21 and the thermal head 13.

Under the above-mentioned state, when the platen drive motor (not shown) is rotated, the platen roller 21 is rotated. With this, the recording paper P is conveyed while being nipped between the platen roller 21 and the thermal head 13. Further, when the recording paper P passes through the thermal head 13, the heating elements of the thermal head 13 are appropriately caused to generate heat. In this manner, various characters, graphics, and the like can be clearly printed on the recording paper P.

The recording paper P having been printed passes between the fixed blade 14 and the movable blade 22, and thereafter is delivered to the outside of the casing 4 through the delivery slot 8. Further, after the recording paper P passes between the fixed blade 14 and the movable blade 22 by a predetermined length, the movable blade 22 is operated. Specifically, when the movable blade drive motor is driven, a driving force is transmitted to the movable blade 22 through the movable blade drive wheel train 49 and the rack 47. With this, the movable blade 22 slides upward (to the cutting position). During the course of movement of the movable blade 22 toward the cutting position, the movable blade main body 41 sequentially rides over the front surface of the fixed blade 14 from both the ends in the rightward and leftward directions L3 to the central portion. Further, the recording paper P is cut when the recording paper P is nipped between the blade edge 41*a* of the movable blade main body 41 and the blade edge 14*a* of the fixed blade 14. That is, in this embodiment, the recording paper P is sequentially cut from both the ends in the rightward and leftward directions L3 to the central portion. The recording paper P having been cut can be used as a printed paper Pa for a receipt, a ticket, or the like. After the recording paper P is cut, the movable blade drive motor is rotated in a direction to reverse to the direction at the time of cutting. With this, the movable blade 22 slides to the separation position.

Incidentally, the printed paper Pa may sometimes remain in the vicinity of the delivery slot 8 of the thermal printer 10 without being taken from the delivery slot 8. In this case, an upstream edge portion of the printed paper Pa in the paper path direction (rear end in FIG. 5) may sometimes enter a portion behind the cutter mechanism (the fixed blade 14 and the movable blade 22) due to a curling or the like (reference symbol Pb in FIG. 5). In this state, when the recording paper P to be printed next is subjected to the cutting operation by the cutter mechanism, a rear end portion of the printed paper Pb having been printed previously is cut by the cutter mechanism together with the recording paper P to be printed next. Then, the rear end of the printed paper Pb having been printed previously is cut into a slender paper piece, and the slender paper piece remains in the printing mechanism 1.

Thus, in this embodiment, there is provided a configuration which includes the upper rib 53 and the lower rib 54 protruding forward from the movable blade guide wall 31. According to this configuration, a clearance between the movable blade 22 and the movable blade guide wall 31 in the forward and backward directions L1 can be reduced. With this, even when a paper piece or the like is present in the printing mechanism 1, the paper piece or the like can be prevented from entering the movable blade receiving portion 35 through the clearance between the movable blade 22 and the movable blade guide wall 31.

In particular, in this embodiment, there is provided a configuration in which the upper rib 53 and the lower rib 54 are arranged in the upward and downward directions L2 with an interval. According to this configuration, during the course of the slide movement of the movable blade 22, even in a case where the paper piece or the like passes through the clearance between the movable blade 22 and the upper rib 53 when the paper piece or the like is drawn into the movable blade receiving portion 35, the lower rib 54 can prevent the paper piece or the like from being drawn. Further, the paper piece or the like can be prevented from entering the movable blade receiving portion 35. Therefore, there is prevented erroneous detection by the sensor 40, which may be caused by phenomena, for example, that the sensor 40 is covered by the paper piece or the like, or that light projected by the sensor 40 is unintentionally blocked by the paper piece or the like. Thus, erroneous operation of the movable blade 22 can be prevented. As a result, the printing mechanism 1 which is highly reliable can be provided.

In this embodiment, there is provided a configuration in which the ribs (for example, the ribs 53 and 54) are simply formed on the movable blade guide wall 31. Thus, an increase in material cost can be suppressed as compared to a case where the movable blade guide wall 31 itself is formed thick, and where the movable blade guide wall 31 and the movable blade 22 are placed close to each other. Further, the upper rib 53 and the lower rib 54 are formed to be separated from each other. With this, the variation of dimensions can be suppressed as compared to the case where the movable blade guide wall 31 itself is formed thick, and the upper rib 53 and the lower rib 54 can be formed with high accuracy. Further, even in a case where the movable blade 22 and the movable blade guide wall 31 come into contact with each other during the slide movement of the movable blade 22, an increase in slide resistance applied between the movable blade 22 and the movable blade guide wall 31 can be suppressed.

In this embodiment, there is provided a configuration in which the lower rib 54 is formed at a position corresponding to the blade edge 41*a* of the movable blade main body 41, which is at the separation position. According to this embodiment, at the separation position, the clearance between movable blade 22 and the movable blade guide wall 31 can be reduced. Thus, the paper piece or the like can be prevented from entering the movable blade receiving portion 35 through the clearance between the movable blade 22 and the movable blade guide wall 31. Further, after the recording paper P is cut, when a rear edge portion of a printed paper Pc remains on the blade edge 41*a* of the movable blade main body 41, the rear edge portion of the printed paper Pc comes into contact with the lower rib 54. With this, the rear edge portion of the printed paper Pc can be prevented from entering the movable blade receiving portion 35 through the clearance between the movable blade 22 and the movable blade guide wall 31. Further, under a state in which the rear edge portion of the printed paper Pc is held in contact with the lower rib 54 from the front, when cutting operation is performed with respect to the next recording paper P, the rear edge portion of the printed paper Pc is pushed upward. With this, the printed paper Pc is guided to the delivery slot 8, and thus generation of the paper piece itself can be prevented.

In this embodiment, there is provided a configuration which has the connecting ribs 55 for connecting the upper rib 53 and the lower rib 54. According to this configuration, when the rear edge portion of the printed paper Pa is to enter a portion between the upper rib 53 and the lower rib 54, the rear edge portion of the printed paper Pa comes into contact with the connecting ribs 55. With this, backward movement of the printed paper Pa is restricted so that the rear edge portion of the printed paper Pa can be prevented from entering the portion between the upper rib 53 and the lower rib 54. As a result, the generation of the paper piece can reliably be prevented.

In this embodiment, each of the clearances between the ribs 53 to 56 and the movable blade 22 is set to be 0.5 mm or less. Thus, the paper piece or the like or the printed paper Pa can effectively be prevented from entering the clearance between the movable blade 22 and the movable blade guide wall 31.

Further, the thermal printer 10 of this embodiment includes the above-mentioned printing mechanism 1. Therefore, occurrence of abnormal operation or control of the printing mechanism 1 can be prevented, and the thermal printer 10 which is highly reliable can be provided.

Further, this embodiment is applied to the thermal printer 10 of a so-called forward delivery type, in which the platen mechanism 2 is arranged below the head mechanism 3 and the printed paper Pa is delivered forward. According to this configuration, through application of this embodiment to the thermal printer 10 of a forward delivery type, in which the paper piece or the like is liable to enter the clearance between the movable blade 22 and the movable blade guide wall 31, the above-mentioned actions and effects can be notably obtained.

The present invention is not limited to the above-mentioned embodiment described with reference to the drawings, and various modifications is conceivable within the technical scope of the present invention. For example, in the above-mentioned embodiment, there is described the example in which the fixed blade 14 is arranged in the head mechanism 3 and in which the movable blade 22 is arranged in the platen mechanism 2, but the present invention is not limited thereto. That is, the movable blade 22 may be arranged in the head mechanism 3, and the fixed blade 14 may be arranged in the platen mechanism 2. In this case, the ribs are arranged on the movable blade guide wall formed in the head mechanism 3. In the above-mentioned embodiment, there is described the case where the movable blade 22 is arranged below the fixed blade 14, but the present invention is not limited thereto. The fixed blade 14 may be arranged below the movable blade 22. In the above-mentioned embodiment, there is described the configuration in which the printed paper Pa is delivered forward, but the present invention is not limited thereto. For example, there may be employed a configuration in which the printed paper Pa is delivered upward.

Besides the above, the components in the above-mentioned embodiment may be replaced by well-known components as appropriate without departing from the gist of the present invention.

What is claimed is:

1. A printing mechanism, comprising:

a head mechanism including a printing head configured to print on a recording paper;

a platen mechanism including a platen roller configured to nip the recording paper with the printing head to feed the recording paper;

a fixed blade arranged in one mechanism of the head mechanism and the platen mechanism; and a movable blade arranged in another mechanism of the head mechanism and the platen mechanism in a slidable manner and configured to cut the recording paper with the fixed blade, the another mechanism comprising:

a movable blade guide wall arranged upstream of the movable blade in a paper path direction of the recording paper;

a first rib protruding from the movable blade guide wall to downstream of the paper path direction; and a second rib formed at a position on the movable blade guide wall, which is separated from the fixed blade with respect to the first rib in a movement direction of the movable blade.

2. A printing mechanism according to claim 1, wherein the movable blade is slidable between a cutting position at which the recording paper is cut between the movable blade and the fixed blade, and a separation position at which the movable blade is separated from the fixed blade; and the second rib is formed at a position on the movable blade guide wall, which corresponds to a blade edge of the movable blade at the separation position.

3. A printing mechanism according to claim 2, wherein the another mechanism protrudes from the movable blade guide wall to downstream in the paper path direction, and includes a third rib for connecting the first rib and the second rib to each other.

4. A printing mechanism according to claim 3, wherein a clearance between the second rib and the movable blade in the paper path direction is set to be 0.5 mm or less.

5. A thermal printer, comprising:

the printing mechanism of claim 4; and a casing to which the printing mechanism is mounted.

6. A thermal printer according to claim 5, wherein the another mechanism is arranged below the one mechanism.

7. A printing mechanism according to claim 1, wherein the another mechanism protrudes from the movable blade guide wall to downstream in the paper path direction, and includes a third rib for connecting the first rib and the second rib to each other.

8. A printing mechanism according to claim 1, wherein a clearance between the second rib and the movable blade in the paper path direction is set to be 0.5 mm or less.

9. A thermal printer, comprising:

the printing mechanism of claim 1; and a casing to which the printing mechanism is mounted.

10. A thermal printer according to claim 9, wherein the another mechanism is arranged below the one mechanism.

* * * * *